United States Patent [19]

Berkau et al.

[11] Patent Number: 4,960,059

[45] Date of Patent: Oct. 2, 1990

[54] LOW NOX BURNER OPERATIONS WITH NATURAL GAS COFIRING

[75] Inventors: Eugene Berkau, Brentwood, Tenn.; Bernard Breen, Laguna Beach, Calif.; James E. Gabrielson, Plymouth, Minn.; Steve Winberg, Pittsburgh, Pa.

[73] Assignee: Consolidated Natural Gas Service Company, Inc., Pittsburgh, Pa.

[21] Appl. No.: 371,059

[22] Filed: Jun. 26, 1989

[51] Int. Cl.[5] ..... F23D 1/00

[52] U.S. Cl. ..... 110/347; 110/262; 110/264; 431/284

[58] Field of Search ..... 110/262, 264, 263; 431/284, 285

[56] References Cited

U.S. PATENT DOCUMENTS 4,597,342 7/1986 Green et al. .

4,790,743 12/1988 Leikert et al. .

4,807,541 2/1989 Masai et al. ..... 110/264

FOREIGN PATENT DOCUMENTS 0280568 8/1988 European Pat. Off. .

*Primary Examiner*—Edward G. Favors

*Attorney, Agent, or Firm*—Buchanan Ingersoll; Barry I. Friedman

[57] ABSTRACT

A method is disclosed which overcomes the problems which tend to occur in the retrofitting of coal burners for low-NOx emission. A gaseous or volatile liquid fuel is introduced into the primary or secondary air with the amount ranging from 2% to 25% of the boiler energy input as necessary to achieve the necessary NOx reduction and improved load following without operational problems. Optionally gas can be injected through gas burners in an amount ranging from 2% to 50% of the boiler energy input.

41 Claims, 3 Drawing Sheets

LOW NOX BURNER OPERATIONS WITH NATURAL GAS COFIRING

BACKGROUND OF THE INVENTION

1. Field of the Invention

The present invention relates to a method of reducing NOx emissions from coal fired furnaces. More particularly it relates to the retrofitting of existing pulverized coal burners for low NOx emissions.

2. Description of the Prior Art

Nitric oxide (NO) is an air pollutant. In many areas of the United States, as well as other countries, methods are sought to reduce its concentration level in flue gases emitted from coal-fired boilers. In the combustion of fuel in the boilers, one problem is the production of nitric oxide due to oxidation of both fuel-bound nitrogen and nitrogen entering with the combustion air.

A portion of the nitric oxide produced by a burner oxidizes to form nitrogen dioxide ($NO_2$) downstream of the combustion process, as well as in the atmosphere. Consequently, production of nitric oxide at the burner results in both NO and $NO_2$, commonly called NOx, being emitted into the atmosphere.

In pulverized coal combustion as practiced in boilers, kilns, and other combustion devices, the pulverized coal is generally conveyed to the burners by the "primary" air stream. The primary air in many cases is preheated, dries the coal and carries the coal out of the pulverizer. The ratio of primary air to coal is typically between 1 and 3 on a weight basis to best accomplish these functions.

As the coal and primary air stream enters the furnace via the burner, heat from downstream combustion is transported by recirculated gases and radiation back to the incoming coal particles causing them to heat and devolatilize. The volatiles that are released from the coal particles mix with the primary air, and the temperature and fuel/air ratio of the mixture eventually become sufficient for ignition to occur. The ignition stability of the burner thus depends mainly upon this process of heat transfer from the primary flame zone, devolatilization of the coal, and ignition of the coal volatiles-primary air mixture and/or the solid coal.

As mentioned above, the region immediately following the ignition zone of the burner, in which the coal devolatilization is completed and the volatiles are burned, is generally termed the "primary flame" zone. In this zone, the bulk of the combustion air, i.e., the "secondary" air which is admitted separately from the primary air, mixes with the fuel and burns. The primary flame zone is followed by a char burnout zone in which the devolatilized coal particles are burned in an atmosphere of typically 15% to 25% excess air (i.e., 3% to 5% $O_2$).

Formation of NO occurs in both the primary flame zone and the char burnout zone. In the primary flame, NO forms primarily from oxidation of volatilized organic nitrogen compounds. In the char burnout zone, NO forms primarily by oxidation of organic nitrogen compounds in the char, and to a minor extent by oxidation of nitrogen in the air. These three NO formation mechanisms can be summarized as follows:

| | | | | |
|---|---|---|---|---|
| Primary Flame: | Volatile N + $O_2$ | → | NO + O | (1) |
| Char Burnout: | Char N + $O_2$ | → | NO + O | (2) |
| | Air Nitrogen $N_2$ + O | → | NO + N | (3) |

-continued

| | | | |
|---|---|---|---|
| Followed by N + $O_2$ | → | NO + O | (4) |

Work by Pohl and Sarofim, reported in "Devolatilization and Oxidation of Coal Nitrogen," showed that a major fraction (approximately 70%) of NO formed in pulverized coal combustion is due to oxidation of volatile fuel nitrogen, i.e., equation 1 above.

One method that is commonly applied to reduce NO formation in pulverized coal firing is the use of low-NOx burners. Low-NOx burners reduce NO formation by delaying the mixing of secondary air into the primary flame. Delay of secondary air mixing produces a lower air/fuel ratio (i.e., air/volatiles ratio) in the primary flame, thus reducing the amount of NO formed from volatile fuel nitrogen. The fact that lowering the air/fuel ratio in the primary flame reduces NO formation is demonstrated by the work of Kawamura and Frey, "Current Developments in Low-NOx Firing Systems," in which the primary air was lowered, causing a reduction in NO formation.

From a practical standpoint, retrofitting low NOx burners to existing pulverized coal fired boilers is the most common approach for implementing the above strategy and for meeting future "acid rain" limitations for NOx emissions. However, while low NOx burners may reduce NOx emissions by 50to 60% compared to conventional pulverized coal burners, retrofitted low NOx burners can cause a number of serious operational problems. These problems include flame impingement, slagging, and incomplete carbon burnout. To overcome these problems, operators will use less coal, a practice known as derating of the boiler. The Electric Power Research Institute (EPRI) has estimated that only 30% of the coal fired utility boilers in the U.S. can be retrofitted with low NOx burners without significant and costly derating penalties. In addition to derating, low NOx burners can cause other operation difficulties. These include poor load following, poor flame holding and stability, and increased sensitivity to upsets.

Additionally, the fuel fed to low NOx burners cannot be adjusted from the different mills, which causes problems in meeting load where mills are out of service. Thus there is a need for a system that will allow boilers retrofitted with low NOx burners to operate as originally designed with conventional burners while achieving NOx emission limitations.

Low NOx burners typically achieve their desired characteristic by burning a portion of the coal in a fuel rich environment followed by mixing more air into the flame which completes the burn out. The portion of the coal burned in the fuel rich environment produces only a very small amount of NOx. In the fuel rich portion there are fewer oxygen molecules and oxygen atoms to react with nitrogen atoms which are present primarily from the coal or with nitrogen molecules which are part of the air.

Unfortunately, the requirement for delayed mixing of part of the air makes the flame longer. In some furnaces the distance from the firing wall to the opposite wall is not adequate to accommodate the long flame. The flame may impinge on the opposite wall causing slagging and corrosion problems and the wall may quench the flame increasing carbon carryover.

Alternately, the flame may be deflected upward and carry much of the combustion energy into the upper part of the furnace resulting in excessive superheater or reheater temperatures. The accommodation to these problems is usually to derate the units, that is, operate them at part load. Thus there is a need for a system which will overcome the problems associated with a longer flame without derating the units.

SUMMARY OF THE INVENTION

The invention disclosed herein is intended to overcome any or all of the problems listed above which tend to occur in original and retrofitted low-NOx coal burners without derating. These burners utilize several forms of pulverized coal including bituminous, subituminous, lignite, anthracite and petroleum coke.

In U.S. patent application Ser. No. 236,608, filed Aug. 25, 1988 and now pending, Breen, Pohl and Lange teach that NOx emissions from a coal burner can be reduced by adding flammable fuels, other than coal, to the combustion zone. Now we have discovered methods of introducing that fuel which were not disclosed in that patent application. The copending application teaches one to introduce a gaseous or volatile liquid fuel into the ignition zone and/or the primary flame immediately downstream of the burner. The flammable fuel may be introduced in a variety of ways, including around the coal source, through a ring burner or through spuds or canes. We have now discovered that the flammable fuel should be added in amounts ranging from 2 to 25% of boiler heat input. We now also prefer to inject the flammable fuel through vane type coal burners wherein gas inlets are provided in the vanes. We also now prefer to inject natural gas through gas burners located below or above the coal burners when injected from 2% to 50% of boiler heat input. Finally we prefer to introduce the flammable fuel in a manner and amount which will make the initial part of the flame fuel rich.

By introducing natural gas into the burners it initiates combustion at the very point where it begins to mix with air. Coal, on the other hand, must be heated until volatiles are expelled from the coal particles and these volatiles mix with air and commence the combustion process. Since the natural gas burns very rapidly, it accomplishes three things. It initiates the coal flame earlier and shortens the coal flame. It makes the early part of the flame effectively more fuel rich and makes the NOx level even lower. Since only the volatile part of the coal reacts initially, effective "fuel richness" can not be calculated based on the total air and coal in any element of space. Finally, natural gas supplies energy itself so any given level of operation can be maintained with less coal.

This process will result in a fundamental change in the operation of a standard burner. The first portion will be very fuel rich and the NOx generated in this portion will be much below previous levels. This change along with burner adjustments and perhaps slight modifications will allow boiler operators to reduce their NOx emissions without the large expense of replacing their burners with low NOx burners, and without the problems of rumble, lost load, slagging, fouling and corrosion.

These and other advantages and features of the present invention will be more fully understood on reference to the presently preferred embodiments thereof and to the appended drawings.

DESCRIPTION OF THE PREFERRED EMBODIMENTS

Figure 1:
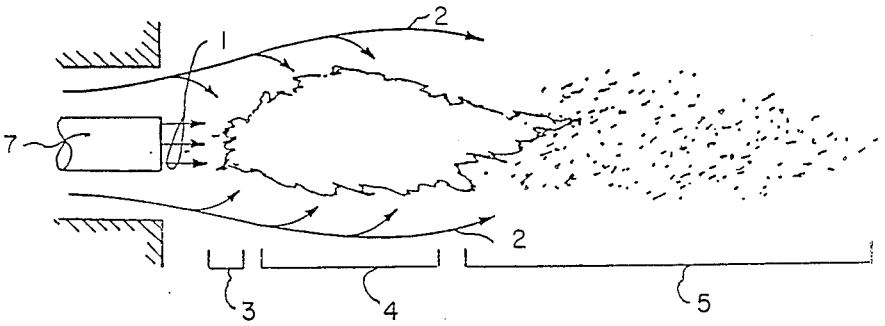
Fig. 1. (Prior Art)
FIG. 1 is a simplified diagram of a pulverized coal burner of the prior art.

Referring to FIG. 1, pulverized coal in a standard furnace is conveyed to the burners by the primary air stream 1. As the coal and primary air stream enter the furnace via the burner 7, heat from downstream combustion is transported by recirculated gases and radiation back to the incoming coal particles, igniting them at zone 3. Immediately following the ignition zone 3 of the burner is the primary flame zone 4, where the bulk of the secondary air 2 mixes with the fuel and burns. The primary flame zone is followed by a char burnout zone 5 in which the devolatilized coal particles are burned.

Figure 2:
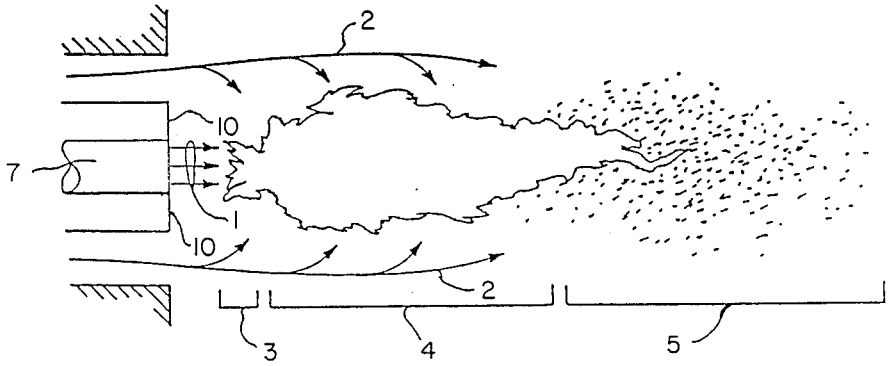
Fig. 2. (Prior Art)
FIG. 2 is a simplified diagram of a low-NOx pulverized coal burner of the prior art.

In FIG. 2, the burner is modified to achieve low-NOx emission. Here, like the standard furnace, pulverized coal and air in a low-NOx furnace are also conveyed to the burner through primary air stream 1. Secondary air 2 is introduced some distance, defined by wall 10, from the primary air stream 1 to delay mixing with the primary air and coal in the primary flame zone 4, lowering the air/fuel ratio and lowering the NOx content of the emissions.

We provide a method by which coal burners are retrofitted for low-NOx emission through the addition of co-fired flammable fuel, namely natural gas.

The gaseous or liquid fuel should be introduced into the ignition zone and/or the primary flame. Preferred methods would therefore be to introduce the gaseous or liquid fuel into the primary air via injectors placed upstream of the burner or into the primary air and/or secondary air via injectors located at the burner exit plane. In the case of injection to the secondary air, the injectors could be located slightly upstream of the burner exit plane. In the case of injection into the primary air stream, the fuel could impinge directly on the air stream within three feet of the burner exit. Alternately fuels could be injected into the primary air/coal stream at any point from the pulverizer to the burner.

Figure 3:
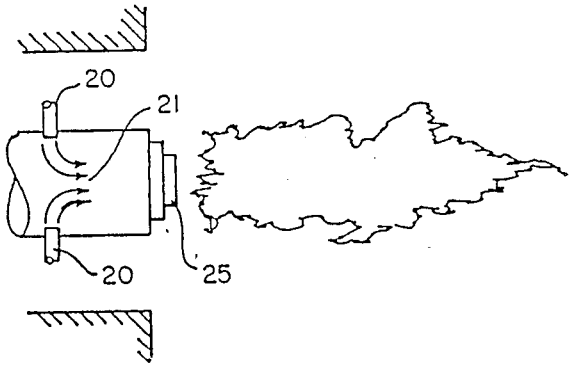
FIGS. 3 through 6 are simplified diagrams of a pulverized coal furnace showing alternative methods to inject gaseous or liquid fuels according to the present invention.
Figure 4:
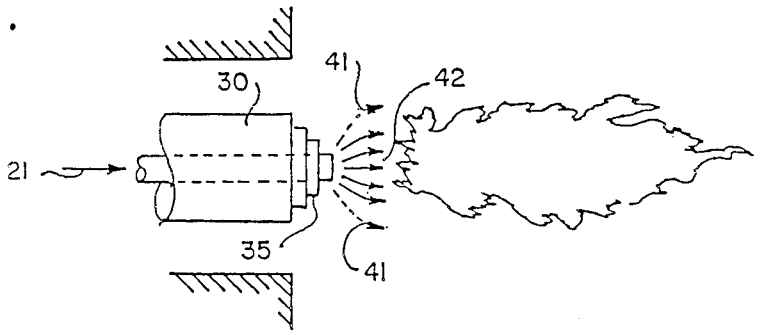
Figure 5:
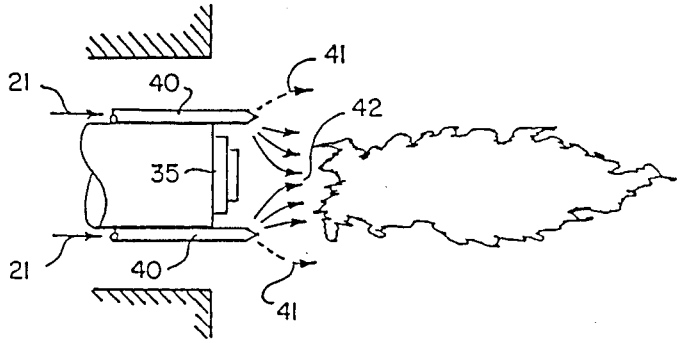
Figure 6:
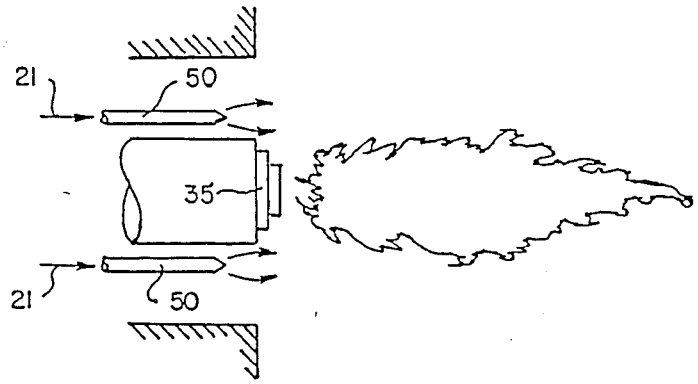

In injecting the gaseous or liquid fuel into either the primary air or secondary air, the injectors would be designed (i.e., number, size, shape, locations, orientations, and fuel pressure) to achieve rapid dispersion of the fuel into the air stream within the air travel distance available prior to encountering the ignition zone or primary flame. Possible injection locations are shown in FIGS. 3 through 6. In some embodiments, the flammable fuel is injected so as to impinge upon the primary air stream at a distance of three feet or less from the burner as in FIG. 4. Other embodiments, such as FIG. 5, intend the fuel to be introduced into the primary air stream at a distance of greater than three feet. In FIG. 3, the gaseous or liquid fuel 21 is injected through nozzles 20 into the primary air/coal stream upstream of the burner 25. In FIG. 4, the gaseous or liquid fuel 21 is injected at the center of the burner at its exit plane 35 using a mixing nozzle 30. In FIG. 5, the gaseous or liquid fuel 21 is injected via spuds or nozzles 40 arranged around the periphery of the primary air pipe at the burner exit plane 35. In FIG. 6, the gaseous or liquid fuel 21 is injected via nozzles 50 into the portion of the secondary air that is nearest the center of the burner. In many low-NOx burners, the secondary air is separated into inner secondary air 42 and outer secondary air 41, and in those cases the device shown in FIG. 6 could be used to inject the fuel only into the inner secondary air 42 (solid arrows). As indicated by the broken lines on the figure, the center injector or peripheral injectors in FIGS. 4 and 5, respectively, could be used to inject the gaseous or liquid fuel into the inner secondary air as well as into the primary air.

We have found that the amount of gas which is injected in the ways shown in FIGS. 3 through 6 should be from 2% to 25% of the boiler heat input. The specific amount to be injected can be determined by adjusting gas input within this 2% to 25% range and measuring NOx emissions. The input level which corresponds to the lowest NOx emissions while providing sufficient volatile energy according to FIG. 2 should be selected.

This invention addresses two concerns of pulverized coal combustion:

(1) further reduction of NOx produced by commercially available low-NOx burners, and (2) maintenance of a stable flame on these burners so that coals having a wider range of properties can be successfully and stably burned.

Natural gas introduced into the burners shown in FIGS. 3 through 6 initiates combustion at the very point where the gas mixes with the air. Because natural gas burns rapidly, the coal flame is initiated earlier and becomes shorter. The early part of the flame is more fuel rich and NOx levels are lowered. Because only the volatile portion of the coal reacts initially, one cannot calculate from the total air and coal in any element of space the effective fuel richness. Finally, gas supplies energy to the system which will increase the BTU output of the burner or allow any given level of operation to be maintained with less coal.

FIGS. 3, 4, 5 and 6 show examples of present preferred embodiments of this invention. In these examples a round burner is shown. However, the process will work just as well on other shaped burners including the rectangular type burners used on tangentially fired boilers.

In many low NOx burners the primary air/fuel stream to each burner is divided into several parts as it exits the burner. Usually three streams are produced by three bluff bodies or vanes. In another embodiment of the invention, the natural gas will be introduced through these vanes. The vanes are very heavy because of the extreme wear to which they are subjected, and this arrangement concentrates the fuel in three areas and enhances the initial fuel richness brought about by the slow mixing nature of the burners. These heavy vanes may be employed in round or rectangular burner designs.

Figure 7:
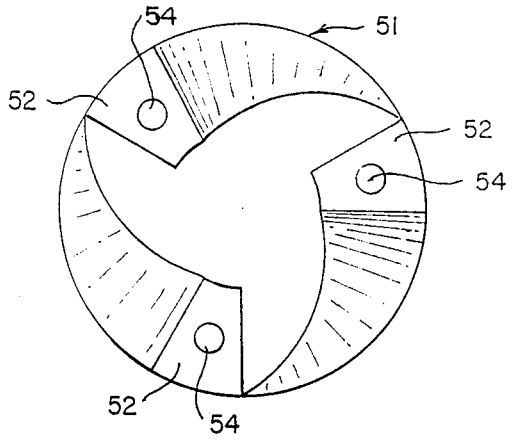
FIG. 7 is a frontal view of a vane type coal burner modified in accordance with the present invention.

FIG. 7 shows the end of a coal pipe 51 with three vanes 52 which split the primary air/coal stream into three fractions. An auxiliary fuel inlet 54 is provided in each vane 52 for injecting flammable fuels such as natural gas. The gas will stabilize the flames and shorten them just as in the embodiments of FIGS. 3 through 6 and all of the above described advantages will accrue. In addition, the natural gas flame at this location will prevent coal from accumulating on the vane.

Figure 8:
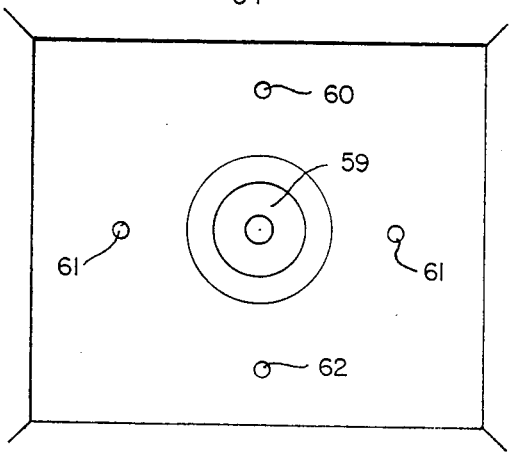
FIG. 8 is a plan view of a coal burner outlet having gas burners associated therewith in accordance with the present invention.

In yet another embodiment of the invention shown in FIG. 8, separate gas burners 60, 61 and 62 are installed in strategic locations in the boiler to be used in conjunction with the low NOx burners 59 to achieve the same results as prior embodiments of low NOx burners, but having the additional benefit of further improved superheat/reheat steam temperature control. In this embodiment, the amount of natural gas can range from 2 to 50% of the boiler heat input. By using a plurality of burners at various locations the superheat and reheat steam temperatures can be closely controlled by adjusting the elevation at which the gas is introduced. The gas burners may be located above 60, below 62 or at the same level 61 as the coal burner 59.

Figure 9:
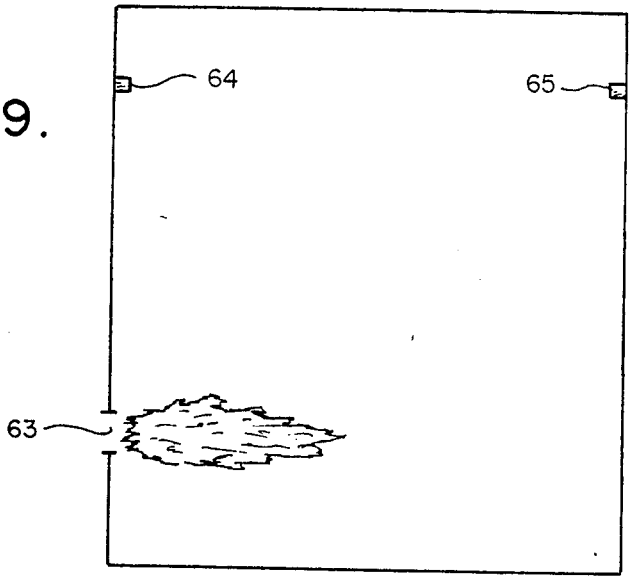
FIG. 9 is a longitudinal, elevational simplified diagram of a pulverized coal furnace to which gas burners have been added for introducing flammable fuels in accordance with the present invention.

Another embodiment shown in FIG. 10 also uses separate gas burners 64 and 65 but introduces the gas higher in the furnace than in the previous embodiment. Gas may be introduced through either or both of burners 64 and 65. This embodiment involves operating the low NOx burner at the maximum load possible without impingement, slagging, or carbon burnout problems. The amount of natural gas used is that necessary to recover the load lost by operating the low NOx burners at reduced capacity to prevent operational problems, which is typically 2 to 50% of the boiler heat input. Where the amount of gas used exceeds 10% of the boiler input, this embodiment has an additional advantage over the embodiment of FIG. 9 in that it results in further NOx reductions when the gas is introduced as a "reburn" fuel.

By using natural gas as shown in FIGS. 3, 4, 5 and 6, the operation of a burner can be changed. Sufficient natural gas can be introduced into a burner to make the initial flame fuel rich. Thus, the technique can be used with a normal or standard burner causing it to function as a low NOx burner. By using natural gas for 2% to 30% of the energy input the initial part of the flame can be made quite fuel rich. Thus the NOx emissions will be reduced.

The methods described above to inject gaseous or liquid fuels for stabilization and improvement of low-NOx burner performance can also be applied to conventional pulverized coal burners. Present practice is to fire ignitor torches, present on the burners, to stabilize ignition of low-volatile coals. However, the methods described above may accomplish flame stabilization with the use of less fuel than is required to operate the ignitor torches, and reduce nitrogen oxide formation as well.

While we have described a present preferred embodiments of our invention, it is to be distinctly understood that the invention is not limited thereto but may be otherwise embodied and practiced within the scope of the following claims.

We claim:

1. An improved combustion method for reducing NOx emissions from a coal burner of the type where pulverized coal is injected into a combustion zone, wherein the improvement comprises the addition of at least one flammable fuel, other than coal, the addition being from 2% to 25% of the total energy input into the combustion zone, wherein the addition provides at least one of NOx reduction, stable ignition, prevention of flame lift-off, elimination of rumble, recovery of lost load and reduction of slagging, fouling and corrosion.

2. A method as described in claim 1 wherein the pulverized coal is selected from the group consisting of bituminous, subbituminous, lignite, anthacite and petroleum coke.

3. A method as described in claim 1 wherein the coal burner is of the low-NOx type.

4. A method as described in claim 1 wherein injecting the flammable fuel lowers a ratio of air to fuel and thereby reduces NOx emissions.

5. A method as described in claim 1 wherein the flammable fuel is a gas.

6. A method as described in claim 5 wherein the gaseous fuel is natural gas.

7. A method as described in claim 1 wherein the flammable fuel is a liquid.

8. A method as described in claim 7 wherein the liquid fuel is a petroleum product.

9. A method as described in claim 1 utilizing a coal burner having primary and secondary air streams, wherein the flammable fuel is added to the secondary air stream.

10. A method as described in claim 1 utilizing a coal burner having primary and secondary air streams, wherein the flammable fuel is added to the primary air stream.

11. A method as described in claim 1 utilizing a coal burner having primary and secondary air streams, wherein the flammable fuel is caused to impinge directly on the primary air stream within three feet of a point where the pulverized coal enters the burner.

12. A method as described in claim 1 utilizing a coal burner having primary and secondary air streams, wherein the flammable fuel is introduced into the primary air stream at a distance of equal to or greater than three feet from the burner.

13. A method as described in claim 1 wherein the flammable fuel is introduced into the pulverized coal near a location where the coal exits a pulverizer.

14. A method as described in claim 1 wherein the flammable fuel is introduced into the pulverized coal before the coal is broken into individual burner streams.

15. A method as described in claim 1 where the flammable fuel is introduced around a source of the coal.

16. A method as described in claim 1 wherein the flammable fuel is introduced through a ring burner.

17. A method as described in claim 1 wherein the flammable fuel is introduced through spuds.

18. A method as described in claim 1 wherein the flammable fuel is introduced through vanes.

19. A method as described in claim 1 where the flammable fuel concentration is adjusted to control one of reheat and superheat temperatures.

20. A method as described in claim 1 wherein the flammable fuel is introduced through a conduit placed within a primary air and pulverized coal line.

21. An improved combustion method for reducing NOx emissions from a coal burner of the type having vanes wherein the improvement comprises injecting into a combustion zone at least one flammable fuel comprising from 2% to 50% of total energy input into the combustion zone, other than coal, through inlets provided in the vanes, to facilitate stable ignition and prevent flame lift-off.

22. A method as described in claim 21 wherein the pulverized coal is selected from the group consisting of bituminous, sub-bituminous, lignite, anthacite and petroleum coke.

23. A method as described in claim 21 wherein the flammable fuel is from 2% to 25% of total energy input into the combustion zone.

24. A method as described in claim 21 wherein injecting flammable fuel lowers a ratio of air to fuel and thereby reduces NOx emissions.

25. A method as described in claim 21 wherein the flammable fuel is a gas.

26. A method as described in claim 25 wherein the gaseous fuel is natural gas.

27. A method as described in claim 21 wherein the flammable fuel is a liquid.

28. A method as described in claim 27 wherein the liquid fuel is a petroleum product.

29. An improved combustion method for reducing NOx emissions from a coal burner of the type where pulverized coal is injected into a combustion zone, wherein the improvement comprises the addition of at least one flammable fuel, other than coal, through gas burners to facilitate stable ignition and prevent flame lift-off, the addition being from 2% to 50% of total energy input into the combustion zone.

30. A method as described in claim 29 wherein the pulverized coal is selected from the group consisting of bituminous, sub-bitumminous, lignite, anthacite and petroleum coke.

31. A method as described in claim 29 wherein the gas burners are located below the coal burners.

32. A method as described in claim 29 wherein the gas burners are at the same elevation as the coal burner.

33. A method as described in claim 29 wherein the gas burners are located above the coal burners.

34. A method as described in claim 29 wherein the flammable fuel is adjusted to control one of reheat and superheat temperatures.

35. A method as described in claim 29 wherein such adjustment as available in a normal burner is used to enhance the low NOx performance of the burner.

36. A method as described in claim 29 wherein a throat of the burner is restricted to improve low NOx burner performance.

37. A method as described in claim 29 wherein a throat of the burner is increased in size to improve low NOx burner performance.

38. A method as described in claim 29 wherein a cross section of a primary air/fuel pipe is enlarged so as to reduce exit velocity and improve low NOx burner performance.

39. A method as described in claim 29 wherein a cross section of a primary air/fuel pipe is decreased so as to increase exit velocity and improve low NOx burner performance.

40. A method as described in claim 29 wherein a primary air/fuel stream exits the burner substantially in an axial direction.

41. A method as described in claim 29 wherein a primary air/fuel stream exits the burner with angular as well as axial velocity.

* * * * *

UNITED STATES PATENT AND TRADEMARK OFFICE

CERTIFICATE OF CORRECTION

PATENT NO. : 4,960,059

DATED : October 2, 1990

INVENTOR(S) : BERNARD BREEN, EUGENE BERKAU, JAMES GABRIELSON, STEVE WINBERG

It is certified that error appears in the above-identified patent and that said Letters Patent is hereby corrected as shown below:

Column 3, line 14, change "subituminous" to --sub-bituminous--.

Column 3, line 27, change "canes" to --vanes--.

Column 7, line 8, claim 2, change "subbituminous" to --sub-bituminous--.

Signed and Sealed this

Twenty-eighth Day of January, 1992

*Attest:*

HARRY F. MANBECK, JR.

*Attesting Officer*

*Commissioner of Patents and Trademarks*